US006826870B2

(12) United States Patent
Chiang

(10) Patent No.: US 6,826,870 B2
(45) Date of Patent: Dec. 7, 2004

(54) ADJUSTABLE AUTOMATIC POSITIONING HINGE FOR A GLASS DOOR

(76) Inventor: Fanny Chiang, 11 Fl.-4, No. 16, Chungming S. Rd., West. Dist., Taichung (TW)

( * ) Notice: Subject to any disclaimer, the term of this patent is extended or adjusted under 35 U.S.C. 154(b) by 0 days.

(21) Appl. No.: 10/411,231

(22) Filed: Apr. 11, 2003

(65) Prior Publication Data

US 2004/0020130 A1 Feb. 5, 2004

(30) Foreign Application Priority Data

Jul. 30, 2002 (TW) ..... 91211626 U

(51) Int. Cl.[7] ..... E05D 7/08
(52) U.S. Cl. ..... 49/388
(58) Field of Search ..... 49/388, 397, 399; 52/204.58, 204.53, 204.54, 204.62, 204.65, 656.2, 656.4, 656.9, 213, 235

(56) References Cited

U.S. PATENT DOCUMENTS 4,956,954 A * 9/1990 Horgan, Jr. ..... 52/204.53
5,203,115 A * 4/1993 Marinoni ..... 49/388
5,283,978 A * 2/1994 Horgan, Jr. ..... 49/388
5,483,770 A * 1/1996 Marinoni ..... 49/388

* cited by examiner

*Primary Examiner*—Jerry Redman
(74) *Attorney, Agent, or Firm*—Fei-Fei Chao; Bingham McCutchen LLP

(57) ABSTRACT

An adjustable automatic positioning hinge for a glass door has a doorframe bracket, a body, a spindle, a U-shaped male bracket and a U-shaped female bracket. The U-shaped male bracket and the U-shaped female bracket face and are attached to each other. The body is attached to the doorframe bracket, the U-shaped male bracket, the U-shaped female bracket and the spindle pivot relative to the body. A glass door is clamped between the U-shaped male bracket and the U-shaped female bracket. A spindle anchor hole is formed in central protrusion on the male bracket. The spindle has a first threaded hole and a second threaded hole radially formed in the spindle at an obtuse angle and setscrews screwed through the central protrusion into the first threaded hole and the second threaded hole hold and can be used to adjust the spindle.

4 Claims, 7 Drawing Sheets

ADJUSTABLE AUTOMATIC POSITIONING HINGE FOR A GLASS DOOR

BACKGROUND OF THE INVENTION

1. Field of Invention

The present invention relates to a hinge for glass door, and more particularly to an adjustable automatic positioning hinge for a glass door.

2. Description of the Related Art

A conventional automatic positioning hinge for a glass door has too many elements, and the way to attach the conventional hinge to a doorframe is very complex. With reference to FIGS. 6 and 7, the conventional hinge for a glass door comprises a base cover (80), a tram body (81), a support bearing (82), a pivot pin (83), a pivot body (84), a clamp block (86) and a cover plate (85). The tram body (81) has a top surface (not numbered), a bottom surface (not numbered) and a hollow cavity (not numbered) through the tram body (81). The hollow cavity is irregular in shape so making the hollow cavity is difficult. The base cover (80) is mounted on the top surface of the tram body (81). The pivot pin (83) and the support bearing (82) are mounted inside the tram body (81). The pivot pin (83) is inserted through the support bearing (82) and is mounted in the pivot body (84). The support bearing (82) is also mounted on the pivot body by pins (not shown) defined on the support bearing (82). The pins defined on the support bearing (82) are short, and after extensive use, the pins easily break. Furthermore, the pivot pin (83) has an enlarged head with two longitudinal detents and is mounted between two spring guides (87) to position the pivot pin (83). The spring guides (87) are often made of plastic and break when the guides are used for a long time. The clamp block (86) is attached to the pivot body (84) with screws (not numbered), and the cover plate (85) is attached to the pivot body (84) with screws (not numbered). Assembly of the clamp block (86), the pivot body (84) and the cover plate (85) is complex.

To overcome the shortcomings, automatic positioning hinges for glass doors that can precisely position a glass door are still needed, and an automatic positioning hinge for a glass door in accordance with the present invention obviates or mitigates the aforementioned problems.

SUMMARY OF THE INVENTION

The primary objective of the present invention is to provide a simple adjustable automatic positioning hinge for a glass door, which can also make small adjustments to align the glass door with the doorframe when the doorframe is not true.

To achieve the objective, an adjustable automatic positioning hinge for a glass door in accordance with the present invention has a doorframe bracket, a body, a spindle, a U-shaped male bracket and a U-shaped female bracket. The U-shaped male bracket and the U-shaped female bracket face each other and clamp and hold a glass door when the brackets are attached to each other. The U-shaped male bracket and the U-shaped female bracket are securely attached to the spindle and pivot relative to the body that is securely attached to the doorframe. The glass door is clamped between the U-shaped male bracket and the U-shaped female bracket. A first threaded hole and a second threaded hole are defined radially in the cylindrical surface of the spindle at an angle of 172.5° and two setscrew holes are defined in a central protrusion on the male bracket so two setscrews can securely hold the spindle and be used to adjust the spindle relative to the positioning assemblies.

Other objectives, advantages and novel features of the invention will become more apparent from the following detailed description when taken in conjunction with the accompanying drawings.

DETAILED DESCRIPTION OF THE INVENTION

Figure 1:
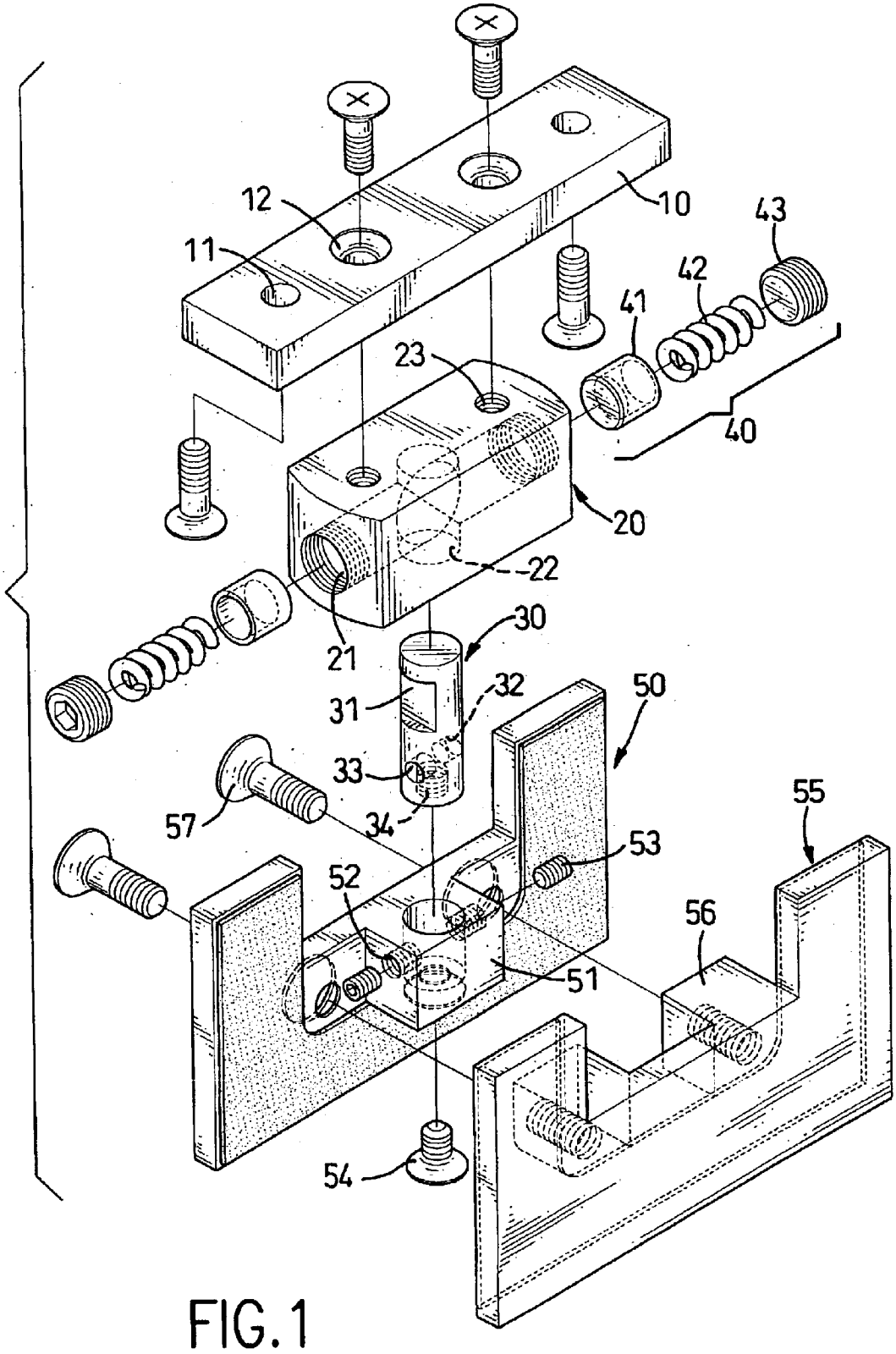
FIG. 1 is an exploded perspective view of an adjustable automatic positioning hinge for a glass door in accordance with the present invention.

With reference to FIG. 1 an adjustable automatic positioning hinge for a glass door in accordance with the present invention comprises a doorframe bracket (10), a body (20), a spindle (30), two positioning assemblies (40), a U-shaped male bracket (50) and a U-shaped female bracket (55).

The doorframe bracket (10) is rectangular and has a doorframe surface (not numbered), a hinge surface (not numbered), four countersunk through holes (11, 12) and four flathead bolts (not numbered). The four countersunk through holes (11, 12) are formed in a line with two outside countersunk through holes (11) and two inside countersunk through holes (12). The two outside countersunk through holes (11) are defined from the hinge surface to the doorframe surface, and the two inside countersunk through holes (12) are formed from the doorframe surface to the frame surface. Two of the flathead bolts pass respectively through the outside countersunk through holes (11) and screw into threaded holes (not shown) in the doorframe (not shown) to securely attach the doorframe bracket (10) to the doorframe.

The body (20) is essentially a rectangle parallelepiped and has a planar outside surface (not numbered), a planar inside surface (not numbered), a planar front surface (not numbered), a planar rear surface (not numbered), two convex end surfaces (not numbered), two blind threaded attachment holes (23), a positioning assembly hole (21) and a spindle hole (22). The blind threaded attachment holes (23) are formed in the outside surface and correspond to the inside countersunk holes (12) in the doorframe bracket (10). Two of the flathead bolts pass through the inside countersunk through holes (12) in the doorframe bracket (10) and screw into the blind threaded attachment holes (23) in the body (20) to securely attach the body (20) to the doorframe bracket (10). The positioning assembly hole (21) is formed through the body (20) from one convex end to the other convex end and has an interior thread (not numbered) at each convex end of the body (20) and a center (not numbered). The spindle hole (22) is a blind hole, is formed in the inside surface of the body (20) and intersects the center of the positioning assembly hole (21).

The spindle (30) is a smooth cylindrical shaft and has a cylindrical surface (not numbered), an outside end (not numbered), an inside end (not numbered), two planar-keyed surfaces (31), a first hole (32), a second hole (33) and a longitudinal threaded hole (34). The planar-keyed surfaces (31) are on diametrically opposite sides of the cylindrical surface and align with the positioning assembly hole (21) when the spindle (30) is inserted into the spindle hole (22). The first hole (32) and the second hole (33) are blind holes and are defined radially in the cylindrical surface of the spindle (30) between the planar keyed surfaces (31) and the inside end of the spindle (30) at an angle of 172.5°. The longitudinal threaded hole (34) is defined in the inside end of the spindle (30).

Each positioning assembly (40) has a positioning cap (41), a spring (42) and a threaded plug (43). The positioning assemblies (40) are mounted in the positioning assembly hole (21) respectively from opposite convex ends of the body (20) after the spindle (30) has been seated in the spindle hole (22) in the body (20). The positioning caps (41) are hollow cylindrical caps with a closed end (not numbered) and an open end (not numbered). The closed ends of the positioning caps (41) respectively face and abut the planar-keyed surfaces (31) on the spindle (30) when the glass door is closed. Each spring (42) has two ends, and one end of each spring (42) is mounted inside the open end of the corresponding positioning cap (41). The threaded plugs (43) are screwed respectively into the interior thread of the positioning assembly hole (21) and compress the springs (42) to hold the closed end of the positioning cap (41) in the planar-keyed surface (31) of the spindle (30).

The U-shaped male bracket (50) has an internal recess (not numbered), an inside surface (not numbered), an outside surface (not numbered), an outside edge (not numbered), a central protrusion (51), two countersunk through holes (not numbered) and two flathead bolts (57). The outside edge of the male bracket (50) faces the doorframe bracket (10). The internal recess is rectangular and has a horizontal edge (not numbered) parallel to the doorframe and two vertical edges (not numbered) perpendicular to the doorframe. The central protrusion (51) is a rectangular parallelepiped, is formed on the inside surface of the U-shaped bracket (50) and has an outside surface (not numbered), an inside surface (not numbered), an interior surface (not numbered), two end surfaces (not numbered), a spindle anchor hole (not numbered), a flathead anchor bolt (54), two setscrew holes (52) and two setscrews (53). The outside surface of the central protrusion (51) is formed flush with the horizontal edge of the internal recess of the male bracket (50). The spindle anchor hole is a blind hole defined in the outside surface of the central protrusion (51), is aligned with the spindle hole (22) in the body (20) and has an open end (not numbered), a closed end (not numbered) and a countersunk through hole (not numbered). The countersunk through hole is formed through the closed end of the spindle anchor hole from the inside surface of the central protrusion (51) and is smaller than the spindle anchor hole. The flathead anchor bolt (54) passes through the countersunk through hole and screws into the longitudinal threaded hole (34) in the inside end of the spindle (30). The setscrew holes (52) are defined respectively in opposite end surfaces of the central protrusion (51) and communicate with the spindle anchor hole. The setscrews (53) are screwed respectively into the setscrew holes (52) to hold the spindle (30) in position.

The U-shaped female bracket (55) has an internal recess (not numbered), an inside surface (not numbered), an outside surface (not numbered), an outside edge (not numbered) and a U-shaped protrusion (56). The outside edge of the female bracket (55) faces the doorframe bracket (10). The internal recess is rectangular and has a horizontal edge (not numbered) and two vertical edges (not numbered). The U-shaped protrusion (56) is essentially a rectangular parallelepiped with a central recess corresponding to the central protrusion (51) on the male bracket (50), is formed on the inside surface of the U-shaped female bracket (55) and has an outside surface (not numbered), an inside surface (not numbered), an interior surface (not numbered), two end surfaces (not numbered) and two threaded holes (not numbered). The outside surface of the U-shaped protrusion (56) is formed flush with the horizontal edge of the internal recess of the female bracket (55). The threaded holes correspond respectively to the two countersunk through holes in the U-shaped male bracket (50). The two flathead bolts (57) pass through the countersunk through holes in the U-shaped male bracket (50) and screw into the threaded holes in the U-shaped protrusion (56) to attach the U-shaped female bracket (55) to the U-shaped male bracket (50).

Figure 2:
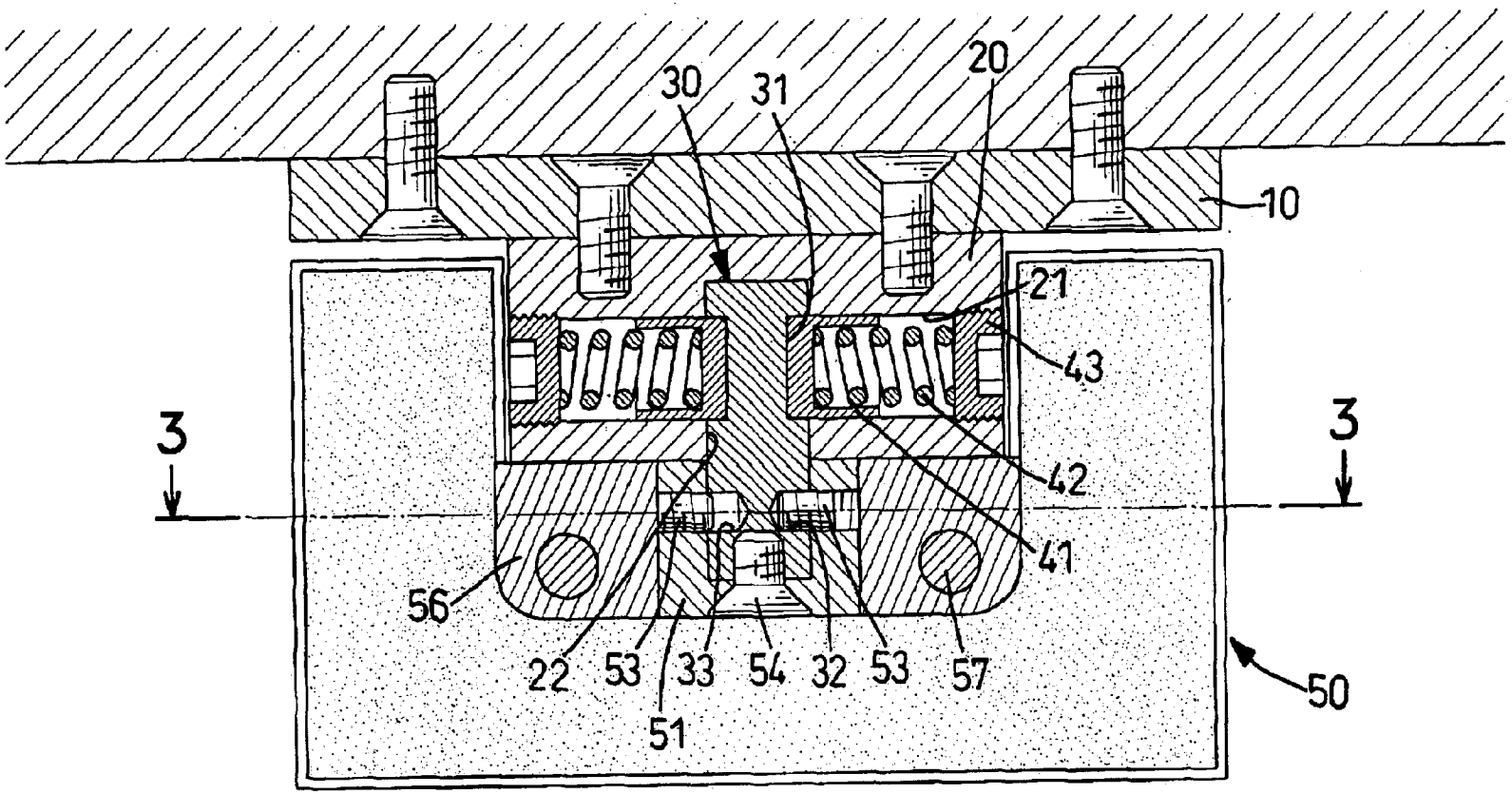
FIG. 2 is a cross sectional front plan view of the hinge in FIG. 1.
Figure 3:
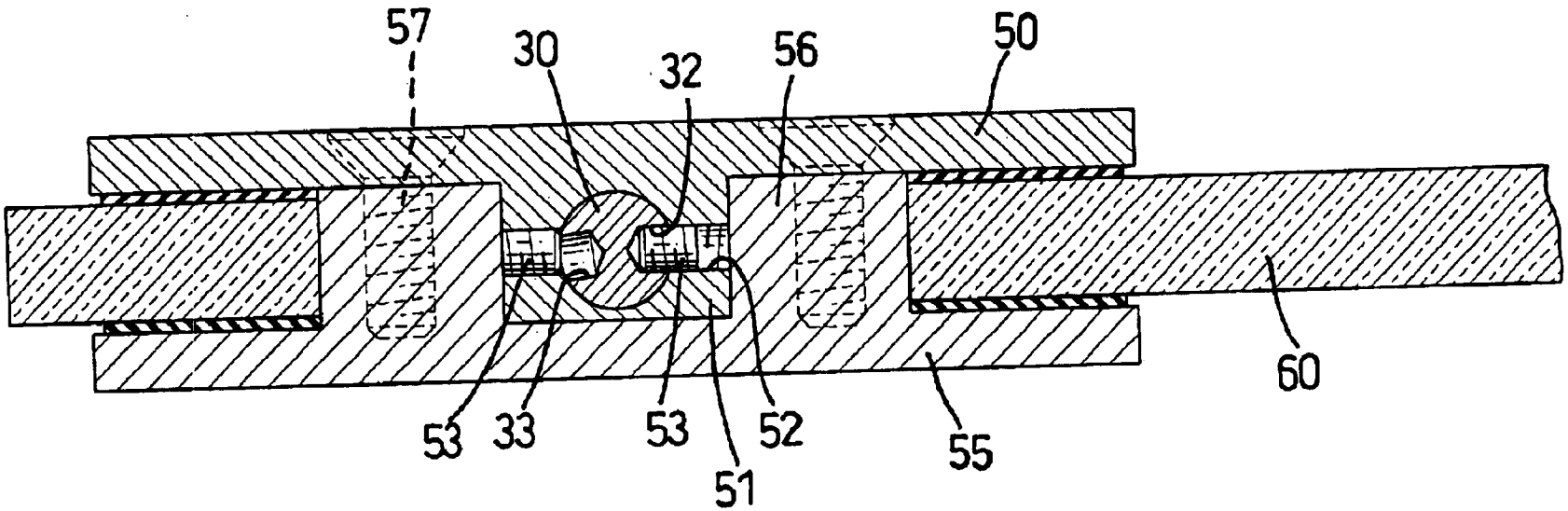
FIG. 3 is a cross sectional top plan view of hinge along line 3—3 in FIG. 2.
Figure 4:
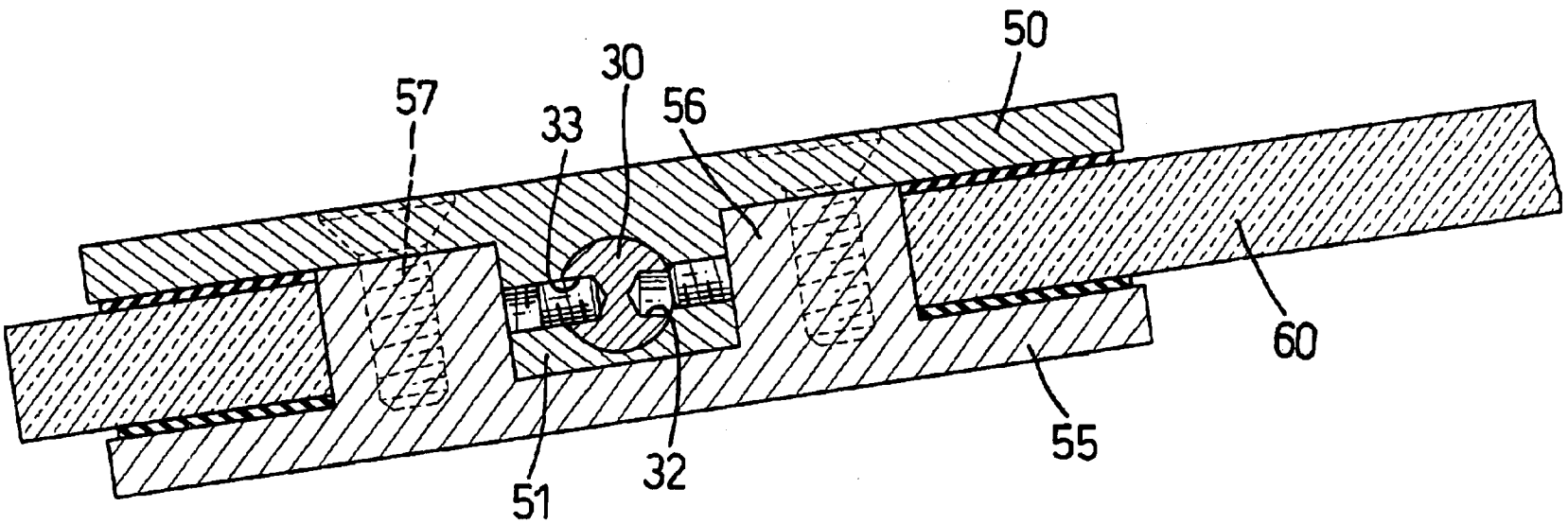
FIG. 4 is an operational cross sectional top plan view of the hinge along line 3—3 in FIG. 2.
Figure 5:
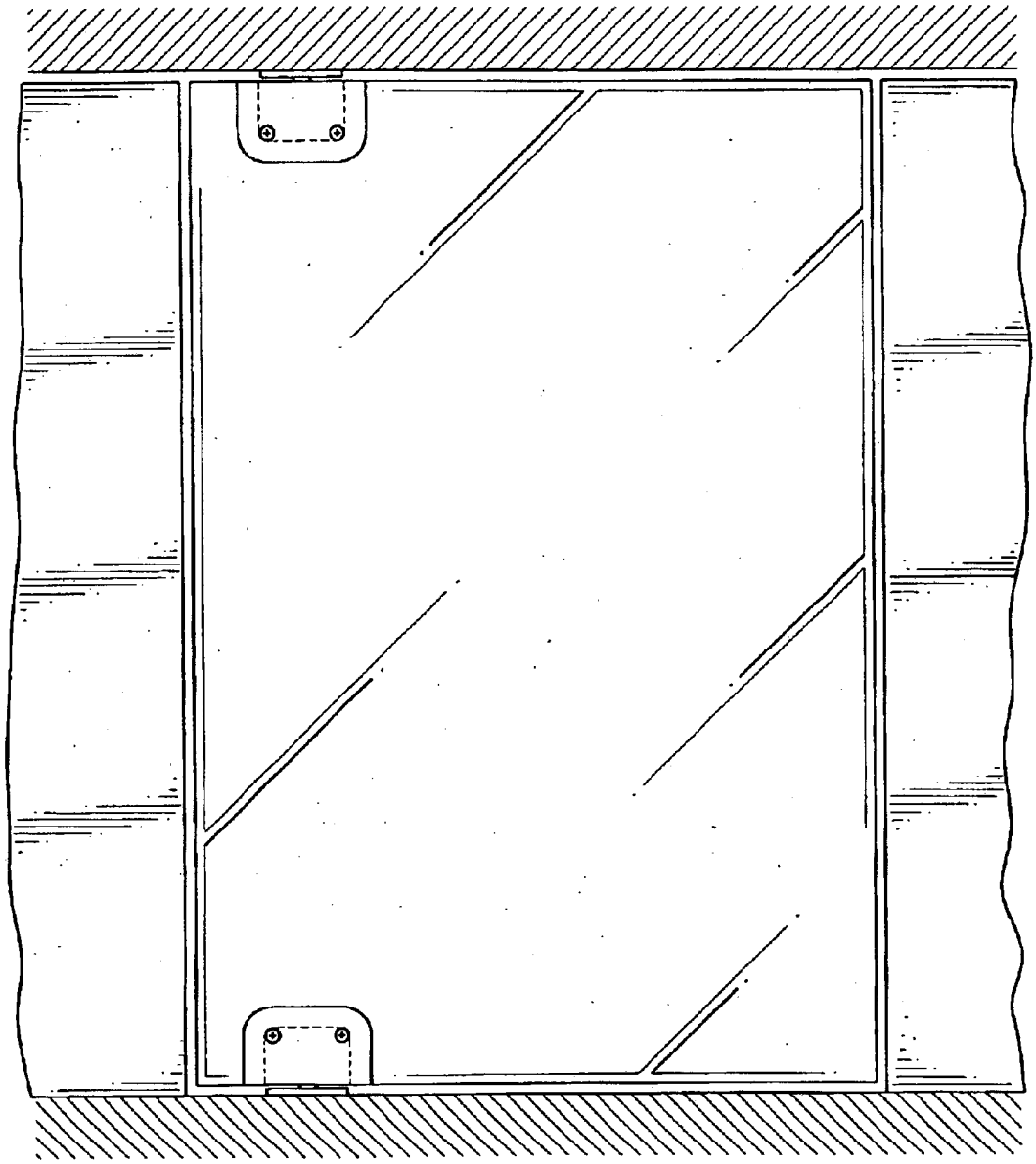
FIG. 5 is a front plan view of the a glass door with two positioning device hinges in FIG. 1.
Figure 6:
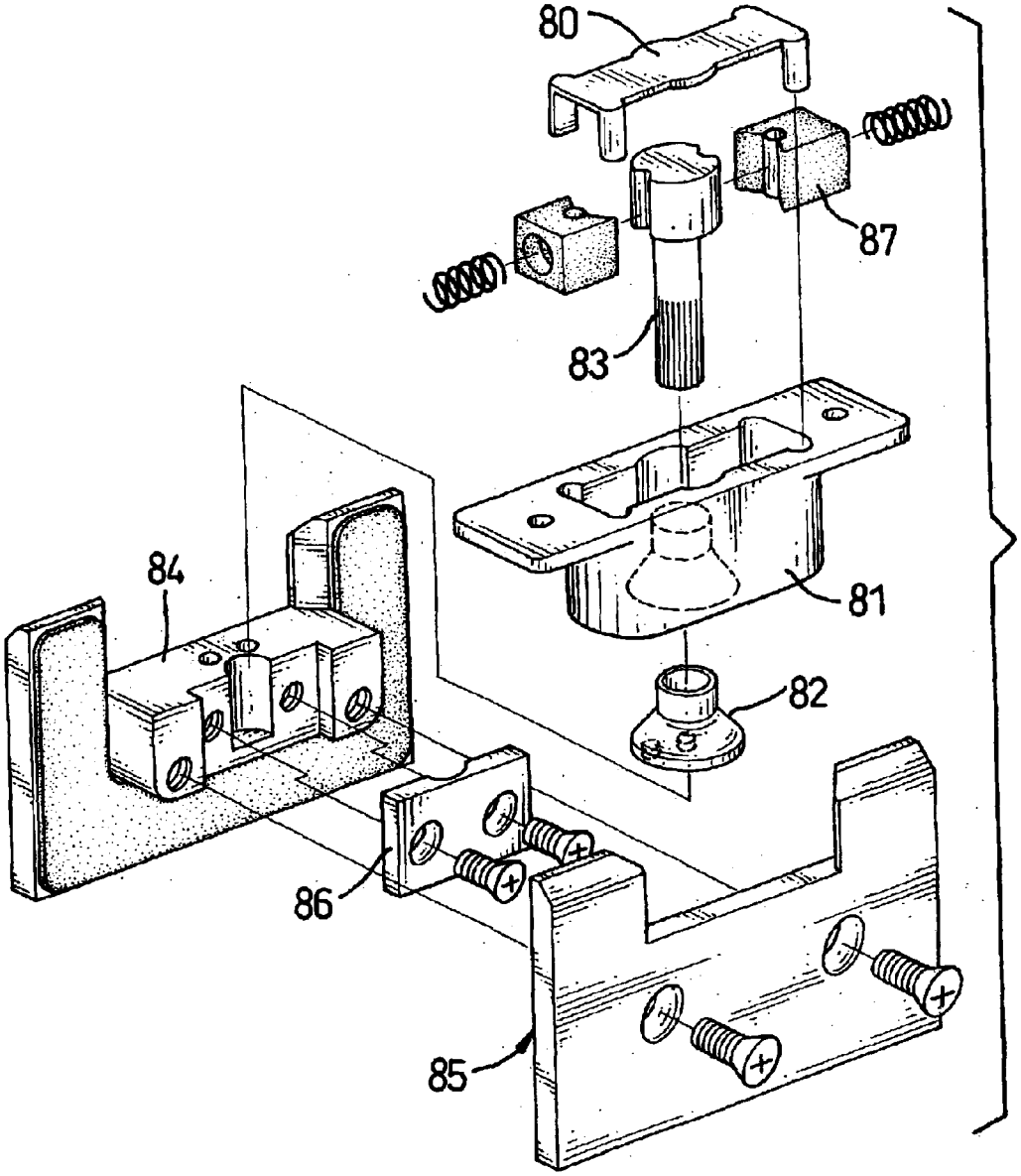
FIG.6 PRIOR ART
FIG. 6 is an exploded perspective view of a conventional positioning hinge in accordance with the prior art.
Figure 7:
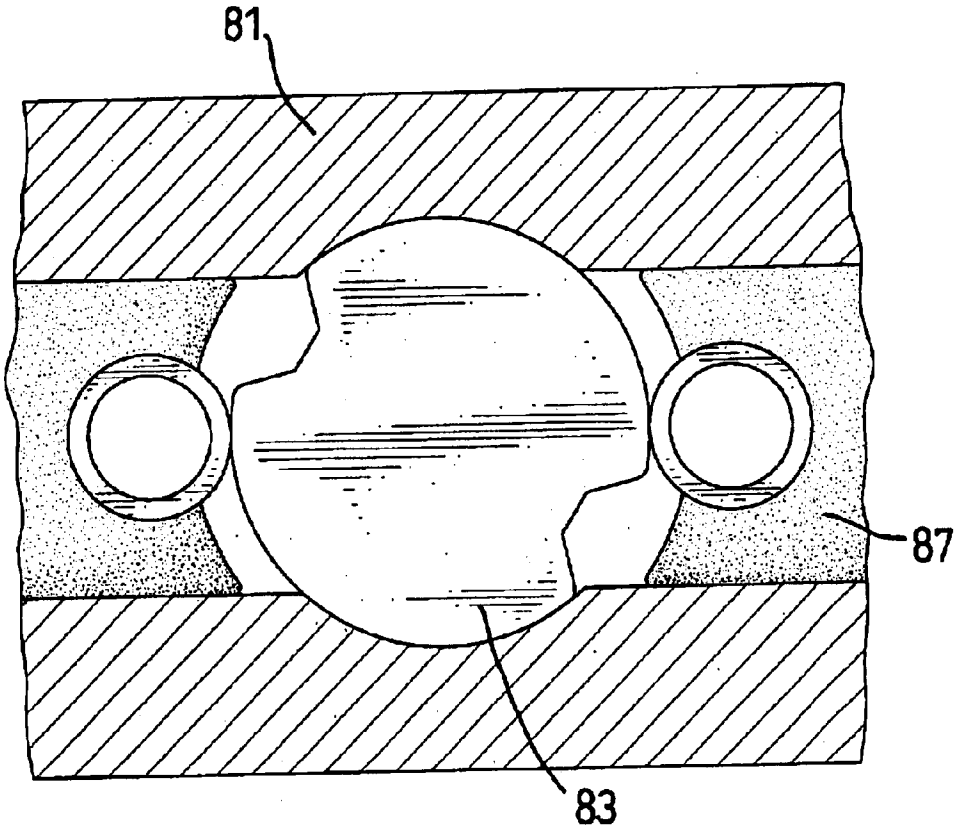
FIG. 7 PRIOR ART
FIG. 7 is an enlarged top plan view in partial section of the enlarged head of the pivot pin in FIG. 6.

With reference to FIGS. 2 to 4, the U-shaped male bracket (50), the U-shaped female bracket (55) and the spindle (30) pivot with respect to the body (20). A glass door (60) is clamped between and held by the U-shaped male bracket (50) and the U-shaped female bracket (55). The spindle (30) is rotatably mounted in the spindle hole (22) in the body (20) and is held in the spindle anchor hole in the central protrusion (51) by the flathead anchor bolt (54). The setscrews (53) screw respectively into the setscrew holes (52). One of the setscrews (53) is inserted into one of the first hole (32) and the second hole (33), and the other setscrews (53) is kept out from the other hole (32,33) due to the unaligned position between the two holes (32,33). In practice, with further reference to FIG. 5, two positioning hinges are respectively mounted on the top and the bottom of a doorframe. By backing one of the setscrews (53) out of the first or second holes (32, 33) in the cylindrical surface of the spindle (30) and inserting the other setscrew (53) into the opposite hole (32, 33), the closed position of the glass door is adjust by 7.5°. Exact alignment of the glass door with the doorframe can also be accomplished by loosening both setscrews (53) of both of the positioning hinges on the glass door, aligning the glass door with the doorframe and tightening the setscrews (53) on the spindles (30).

The invention may be varied in many ways by a person skilled in the art. Such variations are not to be regarded as a departure from the spirit and scope of the invention, and all such modifications are intended to be included within the scope of the following claims.

What is claimed is:

1. An adjustable automatic positioning hinge for a glass door comprising:

a doorframe bracket;

a body securely attached to the doorframe bracket having a planar inside surface;

two convex end surfaces;

a spindle hole formed in the inside surface of the body; and a positioning assembly hole formed through the body from one convex end surface to the other convex end surface and having a center intersecting the spindle hole;

a spindle inserted into the spindle hole and having a cylindrical surface;

two planar-keyed surfaces being on opposite sides of the cylindrical surface and respectively corresponding to the positioning assembly hole;

a first hole defined radially in the cylindrical surface of the spindle; and a second hole defined radially in the cylindrical surface of the spindle and at an angle with the first hole;

two positioning assemblies inserted into the positioning assembly hole and each positioning assembly having a positioning cap with a closed end facing the planar—keyed surfaces and an open end;

a spring having two ends and one end of the spring mounted inside the open end of the corresponding positioning cap; and a threaded plug screwed into the positioning assembly hole and compressing the spring to hold the closed end of the positioning cap in a corresponding one of the planar-keyed surfaces of the spindle;

a U-shaped male bracket pivoted with the body having an internal recess;

an inside surface;

a central protrusion formed on the inside surface and having an outside surface;

two end surfaces;

a spindle anchor hole defined in the outside surface of the central protrusion and being aligned with the spindle hole; and two setscrew holes defined respectively in opposite end surfaces of the central protrusion and communicated with the spindle anchor hole; and two setscrews screwed respectively into the setscrew holes to hold the spindle in position; a U-shaped female bracket screwed with the U-shaped male bracket and having an internal recess;

an inside surface; and a U-shaped protrusion with a central recess corresponding to the central protrusion on the male bracket and formed on the inside surface of the U-shaped female bracket.

2. The adjustable automatic positioning hinge for a glass door as claimed in claim 1 further comprises a longitudinal threaded hole defined inside the end surface of the spindle and a flathead anchor bolt screwed into the central protrusion on the U-shaped male bracket and the longitudinal threaded hole.

3. The adjustable automatic positioning hinge for a glass door as claimed in claim 1, wherein the doorframe further comprises multiple countersunk through holes formed on the doorframe bracket and the body further comprises two blind threaded attachment holes formed in the outside surface and corresponding to two of the countersunk through holes in the doorframe bracket.

4. The adjustable automatic positioning hinge for a glass door as claimed in claim 1, wherein the first hole and the second hole defined in the spindle are at an angle of 172.5°.

* * * * *